US006604278B2

(12) United States Patent
Sera et al.

(10) Patent No.: US 6,604,278 B2
(45) Date of Patent: Aug. 12, 2003

(54) MANUFACTURING METHOD FOR PANEL SWITCH USING MOVABLE CONTACT UNIT AND THE MOVABLE CONTACT UNIT

(75) Inventors: Naoki Sera, Okayama (JP); Yuji Okamoto, Okayama (JP); Tetsutaro Nasu, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 5 days.

(21) Appl. No.: 10/073,413

(22) Filed: Feb. 13, 2002

(65) Prior Publication Data

US 2002/0112948 A1 Aug. 22, 2002

(30) Foreign Application Priority Data

Feb. 16, 2001 (JP) ..... 2001-039824

(51) Int. Cl.[7] ..... H01H 11/00; H01H 1/00; H01H 13/702

(52) U.S. Cl. ..... 29/622; 200/516

(58) Field of Search ..... 200/5 A, 512–517, 200/292; 29/622

(56) References Cited

U.S. PATENT DOCUMENTS

| | | | | |
|---|---|---|---|---|
| 4,033,030 A | * | 7/1977 | Robinson et al. | 29/622 |
| 4,035,593 A | * | 7/1977 | Riniker | 200/5 A |
| 4,249,044 A | | 2/1981 | Larson | 200/5 A |
| 4,365,408 A | * | 12/1982 | Ditzig | 29/622 |
| 4,403,272 A | * | 9/1983 | Larson et al. | 361/749 |
| 4,562,315 A | * | 12/1985 | Aufderheide | 200/5 A |
| 4,703,139 A | | 10/1987 | Dunlap | 200/275 X |
| 5,778,507 A | | 7/1998 | Grannan et al. | 29/412 |
| 5,924,555 A | * | 7/1999 | Sadamori et al. | 200/512 |
| 6,259,046 B1 | * | 7/2001 | Iwama et al. | 200/5 A |
| 2001/0022270 A1 | | 9/2001 | Takahashi | 200/516 |

FOREIGN PATENT DOCUMENTS

| | | | |
|---|---|---|---|
| EP | 1065687 | 1/2001 | H01H/13/70 |
| FR | 2754934 | 4/1998 | H01H/13/70 |
| WO | 96/22858 | 8/1996 | B23P/19/00 |

OTHER PUBLICATIONS

Patent Abstracts of Japan, vol. 016, No. 027, Jan. 23, 1992 & JP 03 241623, Oct. 28, 1991.

* cited by examiner

*Primary Examiner*—J. R. Scott
(74) *Attorney, Agent, or Firm*—Wenderoth, Lind & Ponack, L.L.P.

(57) ABSTRACT

A simple-structured, highly dustproof movable contact unit having positive tactile response, and a panel switch using the same, and each manufacturing method. The movable contact unit contains movable contact (3), base film (11), and separator (4). The movable contact, which is made of a conductive metallic sheet having resiliency, is formed into a bottom-open dome-like shape. The base film holds the movable contact through adhesive layer (12) formed under the film. The base film has projections (13) corresponding to each movable contact, which are formed into a shape conforming to the dome-like movable contact. The upper surface of the separator, which has been subjected to a release treatment, is affixed with the adhesive layer beneath the base film. The root portion of the each projection conforming to the shape of the movable contact is tightly affixed to the separator through the adhesive layer under the base film.

9 Claims, 10 Drawing Sheets

MANUFACTURING METHOD FOR PANEL SWITCH USING MOVABLE CONTACT UNIT AND THE MOVABLE CONTACT UNIT

FIELD OF THE INVENTION

The present invention relates to a movable contact unit, which is typically employed in the operation panel of electronic equipment of various types, and a method of manufacturing the same. It also relates to a panel switch using the movable contact unit and a method of manufacturing the same.

BACKGROUND OF THE INVENTION

In recent years, mobile electronic equipment has expands its type and number. As the electronic equipment becomes compact and lightweight, a smaller and lighter switch has been used for a panel switch for the operation panel of the equipment.

Preferably employed is, in particular, a movable contact unit using a dome-like shaped movable contact that is made of conductive metallic sheet with resiliency. The reason of its popularity is that the movable contact unit can provide: a low profile, positive tactile response in switching operation, and an electrically reliable connection.

Now will be described a conventional movable contact unit and its manufacturing method, and a panel switch using the movable contact unit with reference to FIG. 8 through FIG. 11.

FIGS. 8 and 9 show a sectional view and an exploded perspective view, respectively, of a conventional movable contact unit.

In FIG. 8, base film 51 is formed of an insulating film having flexibility with its outer shape processed into a predetermined shape. Adhesive layer 52, which is formed all over the lower surface of base film 51, adhesively holds each top portion of movable contacts 53 to keep each contact separately. Movable contact 53 is made of conductive metallic sheet having resiliency and is processed into dome-like shape.

Movable contact 53 has, as shown in FIG. 8, truncated cone-shaped peripheral edge 53A and generally spherical-shaped center portion 53B with a slight upward bulge. A drawing process given to the resilient metallic sheet creates smooth contours between center portion 53B and peripheral edge 53A. Separator 54 is made of insulating film 54B having releasable layer 54A on its surface. Movable contact 53 is sandwiched between separator 54 and base film 51. Separator 54 is affixed with adhesive layer 52 lying under base film 51 so that the surface being subjected to the release treatment—releasable layer 54A—covers all over the lower surface of base film 51.

Separator 54 is tightly affixed with base film 51, preventing movable contact 53 from corrosion and the like. Separator 54 also prevents adhesive layer 52 from accidentally sticking to other portions, or from getting foreign matters thereon during transportation and/or storage.

A conventional movable contact unit is structured above. As shown in the sectional view of FIG. 10, prior to use of such a movable contact unit, after separator 54 is peeled off, movable contacts 53 are affixed to wiring board 56 on which plural fixed contacts 55 (55A and 55B) are disposed so as to correspond each movable contact with the fixed contacts. A panel switch is thus structured.

As illustrated in FIG. 10, each central fixed contact 55A is opposed to the center portion of movable contact 53, and the bottom edge of peripheral portion of movable contact 53 is mounted on each of outer fixed contacts 55B. A panel switch unit is thus configured.

Now will be described how such a switch works.

When a depressing force is exerted on movable contact 53 over base film 51, the dome-like portion of movable contact 53 is flipped with a tactile response. By the flip, a portion, which stays over the top portion of the contact, of the lower surface of base film 51 comes into contact with central fixed contact 55A via movable contact 53, so that electric connections are established between contact 55A and contact 55B.

On the other hand, when the depressing force is released, movable contact 53 is now flipped back to its original shape by its own resiliency to open electrically between contacts 55A and 55B.

As described above, flexible base film 51 has been employed in the conventional movable contact unit and the panel switch using the unit. However, if movable contact 53 is disposed at an area adjacent to the outer edges of base film 51 processed into a predetermined shape, the side of the outer edge of base film 51 has less tightly affixed area. Therefore, an outer edge of adhesive layer 52 under base film 51 cannot hold a tight contact with separator 54 or wiring board 56. Such poor adhesion of base film 51 has often caused lack of sealing.

In particular, in the case that movable contact 53 has not smooth contours between generally spherical-shaped center portion 53B and truncated cone-shaped peripheral edge 53A, for example, having a stepped transitional portion in the contour, base film 51 tends to have an air-contained spot thereunder. This forces manufactures to add an extra step checking the unit for the sealing condition by visual inspection.

Besides, the poor sealing described above further causes an undesired phenomenon: it adversely affects connection reliability of the switch section of the panel switch.

That is, in a movable contact unit having such a poor sealing condition, there is a possibility that foreign matters creep into an opening formed between adhesive layer 52 and separator 54 during transportation and/or storage of the movable contact unit. Another possibility is, as the arrow indicated by a dotted line in the partially enlarged sectional view of the outer shape portion in FIG. 11 shows, foreign matters can enter through an opening between adhesive layer 52 and wiring board 56, after the both has been affixed together.

SUMMARY OF THE INVENTION

It is therefore the object of the present invention to provide a highly dustproof movable contact unit and its manufacturing method, and to provide a panel switch using the movable contact unit.

The movable contact unit of the present invention includes a movable contact, a base film, and a separator.

The movable contact is made of resilient conductive metallic sheet, which is formed into a bottom-open, dome-like shape. The base film holds the movable contact with the adhesive layer that is formed under the base film. The base film has sections corresponding to the movable contacts, which are formed into projections fitting with the dome-like shaped movable contact. As for the separator, the release treatment-provided upper surface of the separator is affixed with the adhesive layer lying under the base film. The root portion of the dome-like projection corresponding to the movable contact is tightly affixed to the separator by the adhesive layer under the base film.

The manufacturing method of the movable contact unit of the present invention contains the steps below:

(a) forming the adhesive layer beneath the insulating film-made base film.

(b) allowing the adhesive layer to adhesively hold the top portion of the bottom-open, dome-like shaped movable contact that is made of resilient conductive metallic sheet.

(c) following the step (b), affixing the release treatment-provided upper surface of the separator with the adhesive layer, with the movable contact being sandwiched between the base film and the separator.

(d) following the step (c), applying heat and pressure to the both outer sides of the affixed base film and the separator, thereby:

i) forming the sections corresponding to the movable contacts on the base film into projections fitting with the dome-like shaped movable contact.

ii) firmly affixing the root portion of the dome-like projection that corresponds to the shape of the movable contact to the separator through affixing the adhesive layer to the separator.

The panel switch of the present invention includes a movable contact, a base film, and a wiring board.

In the movable contact unit, the movable contact is made of resilient conductive metallic sheet and is formed into a bottom-open, dome-like shape. The base film of the unit holds the movable contact with the adhesive layer formed beneath the base film. The base film has sections corresponding to the movable contacts, which are formed into projections conforming to the dome-like shaped movable contact. The wiring board has fixed contacts thereon associating with each movable contact. The base film is affixed, with the adhesive layer formed thereunder, to the wiring board.

In addition to the manufacturing steps of the movable contact unit described above, the manufacturing method of the panel switch of the present invention has the steps: i) disposing fixed contacts at positions on the wiring board corresponding to those of the movable contacts of the movable contact unit; ii) peeling off the separator from the movable contact; then iii) affixing the adhesive layer lying under the base film to the wiring board so that the movable contact of the movable contact unit corresponds to the fixed contact on the wiring board.

DESCRIPTION OF THE PREFERRED EMBODIMENT

The preferred embodiments of the present invention are described hereinafter with reference to the accompanying drawings, FIG.1 through FIG.7.

First Preferred Embodiment

Here will be described an aspect of the present invention, referring to the first preferred embodiment.

Figure 1:
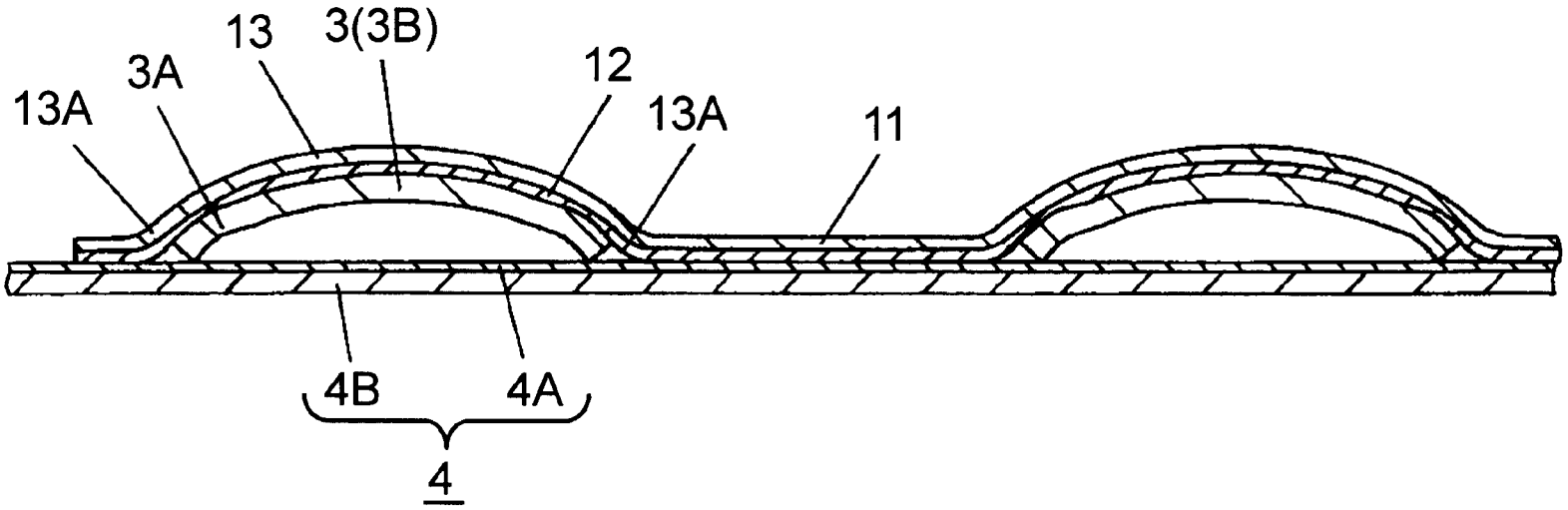
FIG. 1 is a sectional view of a movable contact unit in accordance with a first preferred embodiment of the present invention.

FIG. 1 is a sectional view of a movable contact unit in accordance with a first preferred embodiment of the present invention.

In FIG. 1, base film 11 is made of an insulating film having flexibility, with its outer shape processed into a predetermined shape. Under the base film 11, adhesive layer 12 is disposed all over the lower surface of the film 11. With adhesive layer 12, base film 11 adhesively holds a plurality of dome-like shaped movable contacts 3 to keep each contact separately.

Separator 4 covers all over the lower surface of base film 11 so that movable contact 3 is sandwiched between separator 4 and base film 11.

Separator 4 includes insulating film 4B and release treatment-provided releasable layer 4A laid on film 4B. Releasable layer 4A is affixed to base film 11 with adhesive layer 12 beneath base film 11.

Dome-like shaped movable contact 3 is formed from resilient metallic sheet, through the drawing process, into the shape like this—peripheral portion 3A of movable contact 3 is shaped into a truncated cone; and generally spherical-shaped center portion 53B has a slight upward bulge. The contours between peripheral edge 3A and center portion 53B show a smooth curve.

Movable contact 3 may be formed into other dome-like shapes, not limited to this.

Base film 11 of the embodiment of the present invention has projections 13 corresponding to the movable contacts, which are plastic-deformed into a shape fitting with the dome-like movable contact. Besides, root portion 13A of projection 13 on base film 11 is formed so as to tightly contact with separator 4 through adhesive layer 12. Root portion 13A is located adjacent to peripheral portion 3A of movable contact 3.

Now will be described a manufacturing method of the movable contact unit of the first preferred embodiment of the present invention hereinafter with reference to the sectional views shown in FIG. 2 through FIG. 4.

Figure 2:
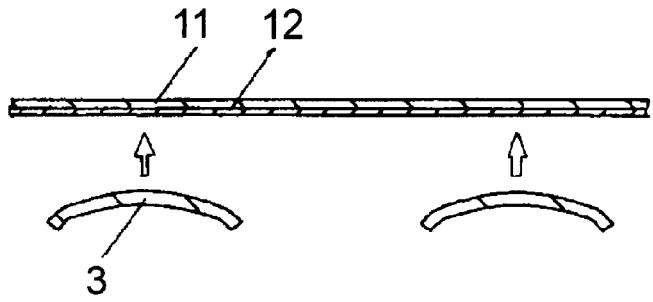
FIG. 2 is a sectional view depicting a step in the manufacturing method of the movable contact unit.

(1) firstly, as shown in FIG. 2, affixing the each top center of prepared bottom-open dome-like shaped movable contact 3 with a predetermined position on adhesive layer 12 formed beneath base film 11.

Figure 3:
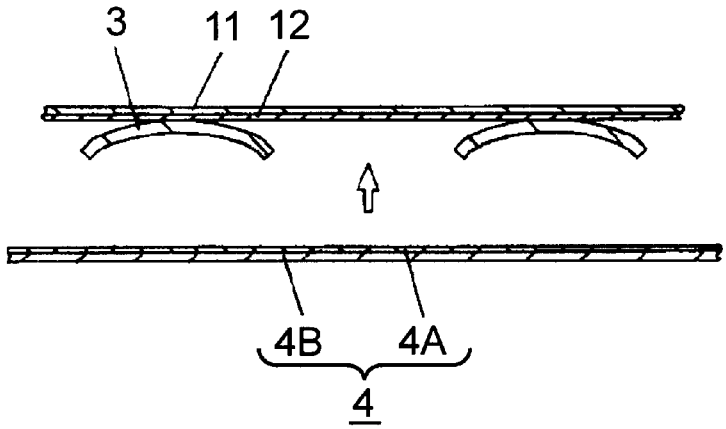
FIG. 3 is a sectional view depicting another step of the manufacturing method of the movable contact unit.

(2) next, as shown in FIG. 3, affixing the upper surface of insulating film-made separator 4—the surface having releasable layer 4A—to all over the surface of adhesive layer beneath base film 11 so that movable contact 3 is sandwiched therebetween.

Figure 4:
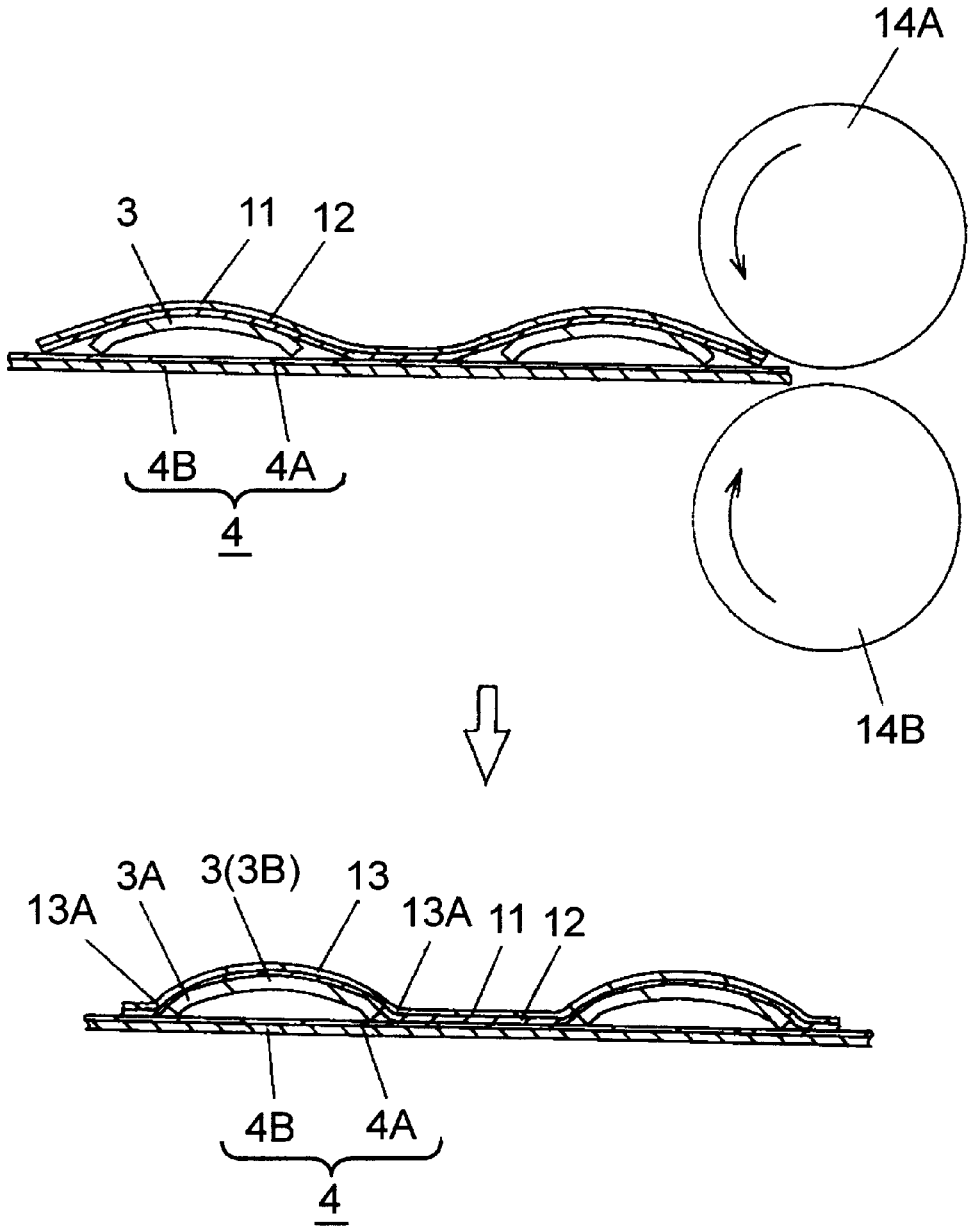
FIG. 4 is a sectional view depicting still another step of the manufacturing method of the movable contact unit.

(3) then, as shown in FIG. 4, applying heat and pressure to base film 11—affixed with separator 4, with the movable contact sandwiched therebetween—by first roller 14A and second roller 14B both of which are pre-heated at a predetermined temperature. Sandwiched between the two rollers, base film 11 with separator 4 is heated and pressed while going through the rollers.

In this step, first roller 14A is made of a material more pliant than that of second roller 14B. This allows the portion of base film 11 corresponding to movable contact 3 to plastic-deform into projection 13, which conforms to the shape of dome-like movable contact 3, while the film goes through between the two rollers. At the same time, root portion 13A of projection 13, which is adjacent to the peripheral portion of movable contact 3, is affixed to separator 4 by adhesive layer 12.

The setting for first roller 14A below will facilitate to easily form projection 13 on base film 11 so as to fit along the dome-like shape of movable contact 3.

When base film 11 is made of polyethylene terephthalate (PET), an adequate pliability—rubber hardness of 30 to 60 (JIS A-type)—will be set to the surface of first roller 14A that properly presses on the upper surface of base film 11. The surface temperature of first roller 14A is defined to range from 50 to 150° C., and the roller pressure is to range from 490 to 980 N/cm; the roller speed is to range from 500 to 1,500 mm per minute. The rollers with these settings realize to form projections 13 that snuggly fit along the outer shape of movable contact 3, pressing base film 11 having movable contact 3 thereunder.

Even in the sloped portion, which extends from center portion 3B having a generally spherical shape with a slight upward bulge to truncated cone-shaped peripheral portion 3A, forms a step-like portion of movable contact 3. In the step-like portion, rollers 14A and 14B provide base film 11 with plastic deformation, forming it into a shape conforming with the curve of movable contact 3. Through the rolling, adhesive layer 12 lying under base film 11 is securely affixed to peripheral portion 3A.

At the same time, root portion 13A of projection 13 on base film 11, which is adjacent to the outside of peripheral portion 3A of movable contact 3, is tightly affixed to separator 4 with adhesive layer 12 beneath the film 11. In this way, a highly dustproof movable contact unit is structured.

The pliable roller, as described above, is used for forming base film 11 into projections 13 that fit with the shape of movable contact 3. The pliability of the roller allows projection 13 on base film 11 to snuggly fit with the shape of movable contact 3 without plastic-deforming the movable contact itself. Besides, base film 11 is sandwiched between the two rollers pre-heated at a predetermined temperature optimal for the material of film 11. The press with heat allows projection 13 to have a just-fit with the shape of movable contact 3. In this way, a highly dustproof movable contact unit can be realized with ease and with a low-cost.

The explanation above is made on the method in which base film 11 and separator 4 having movable contact 3 therebetween passes through between an upper and lower rollers so as for them to be pressed and heated by the two rollers. It is also possible to employ a pressing device for heating and pressing.

The detailed settings for the rollers described earlier are applicable in the case that base film 11 is made of PET. When other materials are used for the film, the heating and pressing conditions may be determined suitable for the material.

The movable contact unit of the embodiment of the present invention, as described above, not only peripheral portion 3A of movable contact 3 is tightly affixed with adhesive layer 12, but also root portion 13A of plastic-deformed projection 13—the area adjacent to peripheral portion 3A—is securely affixed to separator 4 with adhesive layer 12. This fact forms the movable contact unit into a tightly sealed structure, realizing an advantageous movable contact unit, that is, being easily manufactured by simple production facilities, simply structured, and highly dustproof.

In this way, the movable contact unit is capable of prevent movable contact 3 from corrosion, or from getting foreign matters therein during transportation and /or storage.

Besides, in the case that the movable contact is disposed at the area adjusting to the outer peripheral edge of a film processed into predetermined shape, the adhesive layer, at the outer peripheral edge portion of the film, tightly affixed to the separator. Therefore, in this case too, the highly dust proof structure is obtained.

In the manufacturing method of movable contact unit in the present invention, base film 11 affixed with separator 4 having movable contact 3 therebetween goes thorough between the two rollers—the upper and lower rollers—pressed and heated.

As described above, the movable contact unit of the present invention is able to be produced by the simple manufacturing method.

In addition, the roller for the side of projection 13 on movable contact 3 has more pliant material than the other roller has. This allows base film 11 to smoothly form into projection 13 conforming to the outer shape of dome-like movable contact 3. It therefore facilitates the continuous production of very inexpensive movable contact unit.

Here will be described the panel switch using the movable contact unit of the embodiment.

Figure 5:
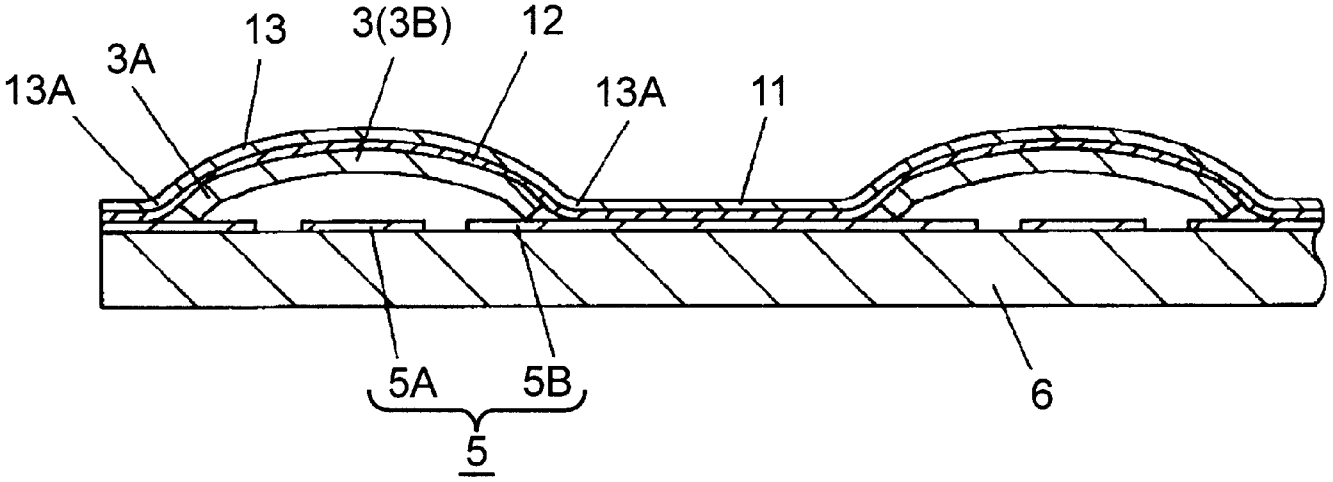
FIG. 5 is a sectional view depicting a part of a panel switch employing the movable contact unit.

FIG. 5 is a sectional view depicting a part of a panel switch employing the movable contact unit.

As shown in FIG. 5, fixed contacts 5A and 5B corresponding to movable contacts 3 are disposed on wiring board 6. The movable contact unit shown in FIG. 1 from which separator 4 is removed is affixed onto wiring board 6 with adhesive layer 12 beneath base film 11 to form a panel switch.

In the panel switch above too, projections 13 on base film 11, which conform to dome-like shaped movable contact 3, are plastic-deformed. Therefore, root portion 13A is tightly affixed to wiring board 6 with adhesive layer 12 beneath film 11 to keep an enclosed space thereunder. The airtight condition realizes a highly dustproof panel switch, thereby providing the switching portion with high connection reliability.

Even in the case that movable contact 3 is placed at the peripheral edge of base film 11, adhesive layer 12 on the side of the peripheral edge of plastic-deformed projection 13 has intimate contact with wiring board 6, as is the case described above. This fact minimizes effects from the surrounding atmosphere on the contact portion of the switch.

Now will be briefly described how the panel switch works.

When a depressing force is applied onto each center portion 3B of movable contacts 3, each contact 3 partially flips over its shape. By the flip, each center portion 3B comes into contact with fixed contacts 5A and 5B, thereby establishing electric connections between contacts 5A and 5B.

In the panel switch, root portion 13A of projection 13—the area adjacent to peripheral portion 3A of movable contact 3—is tightly affixed to wiring board 6. Therefore, movable contact 3, even in the case that it places at the peripheral edge of base film 11, endures repetitive use, providing a reliable connection between the wiring board and the fixed contact over the long term.

Second Preferred Embodiment

Here will be described another aspect of the present invention, referring to the second preferred embodiment.

Those parts corresponding to the components described in the first preferred embodiment will be identified with the same references, and detailed explanations thereof will be omitted.

Figure 6:
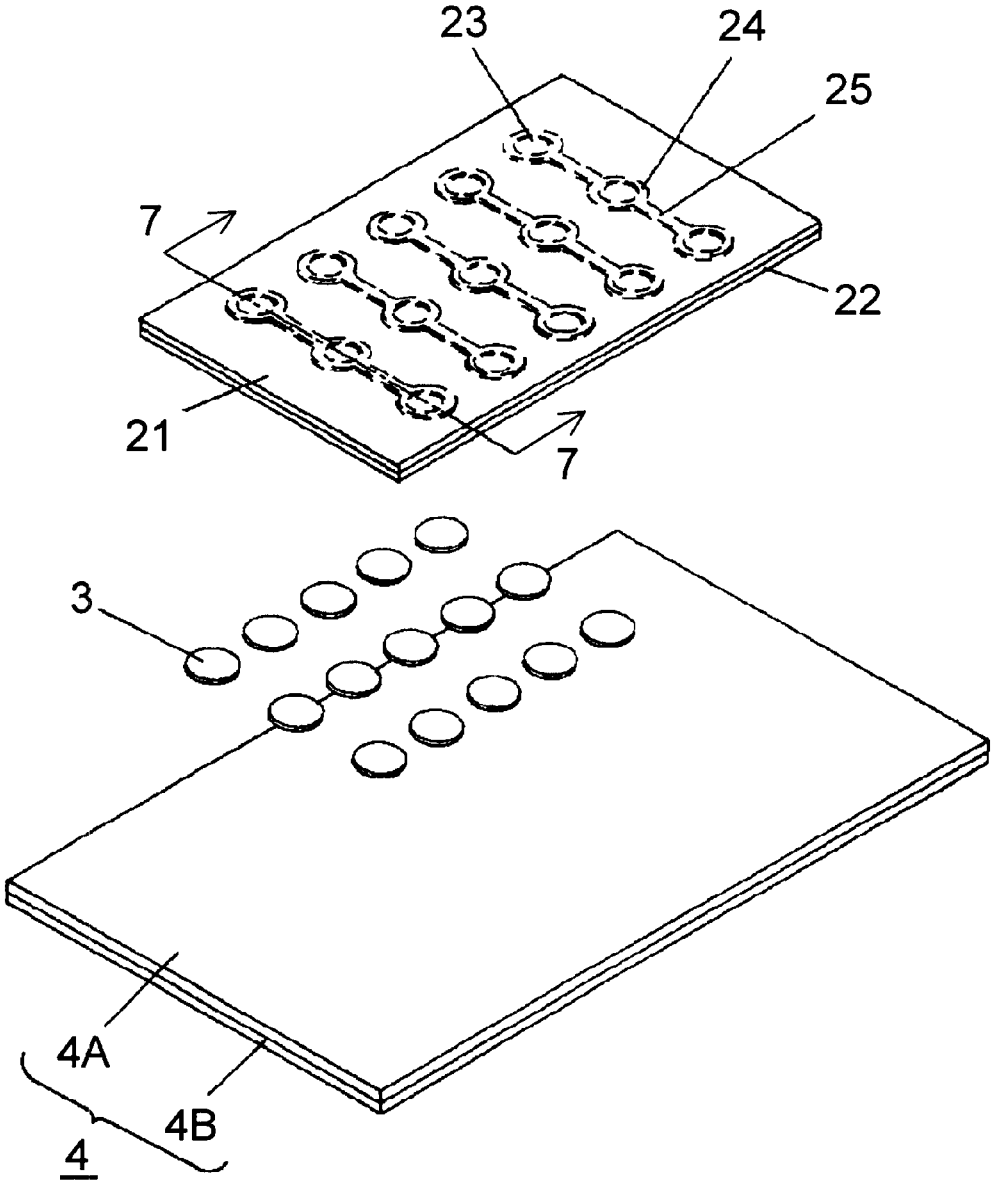
FIG. 6 is an exploded perspective view of a movable contact unit in accordance with a second preferred embodiment of the present invention.
Figure 7:
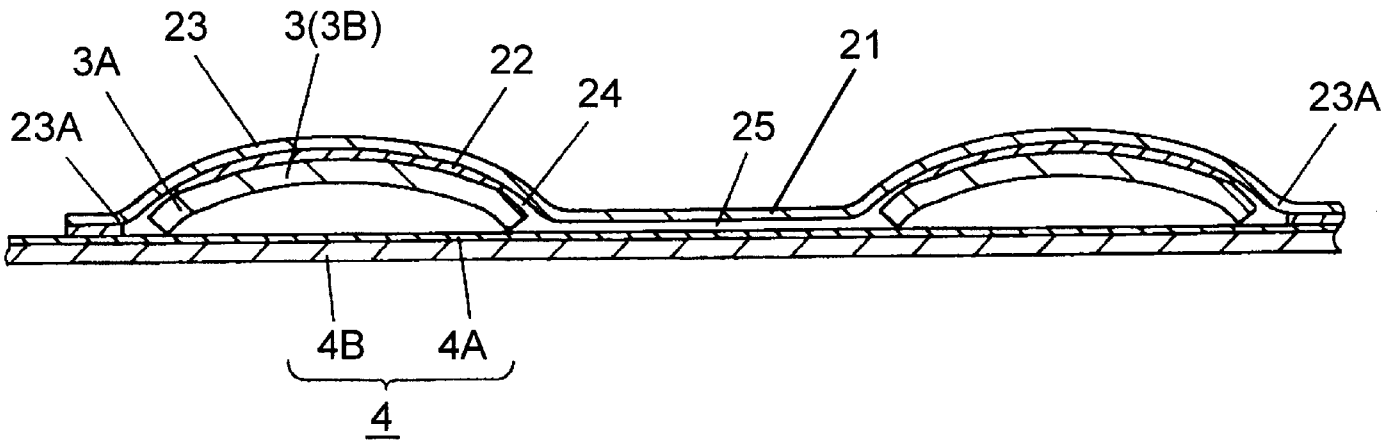
FIG. 7 is a sectional view, taken along the line 7—7, of the movable contact unit.
Figure 8:
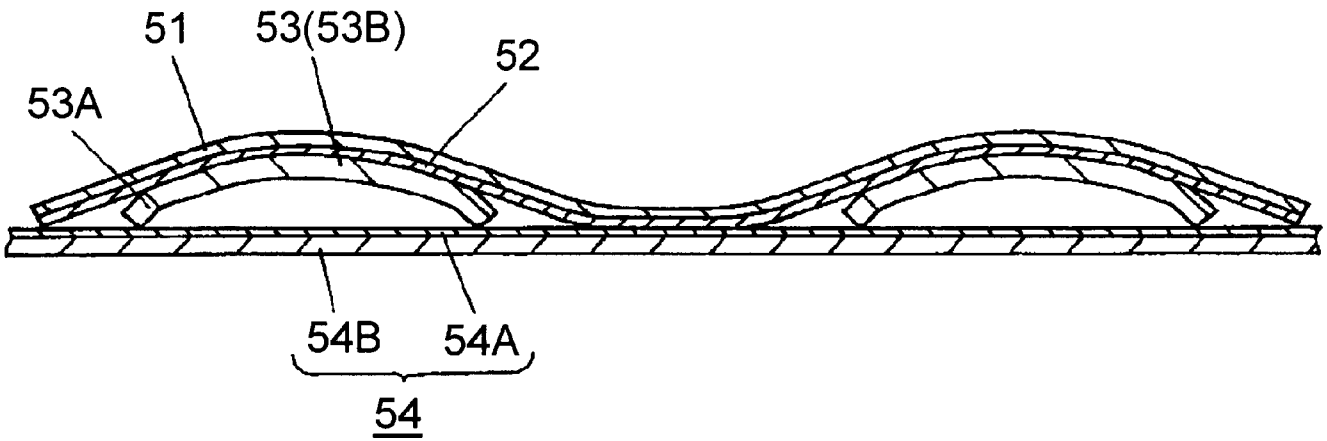
FIG. 8 PRIOR ART
FIG. 8 is a sectional view of a prior-art movable contact unit.
Figure 9:
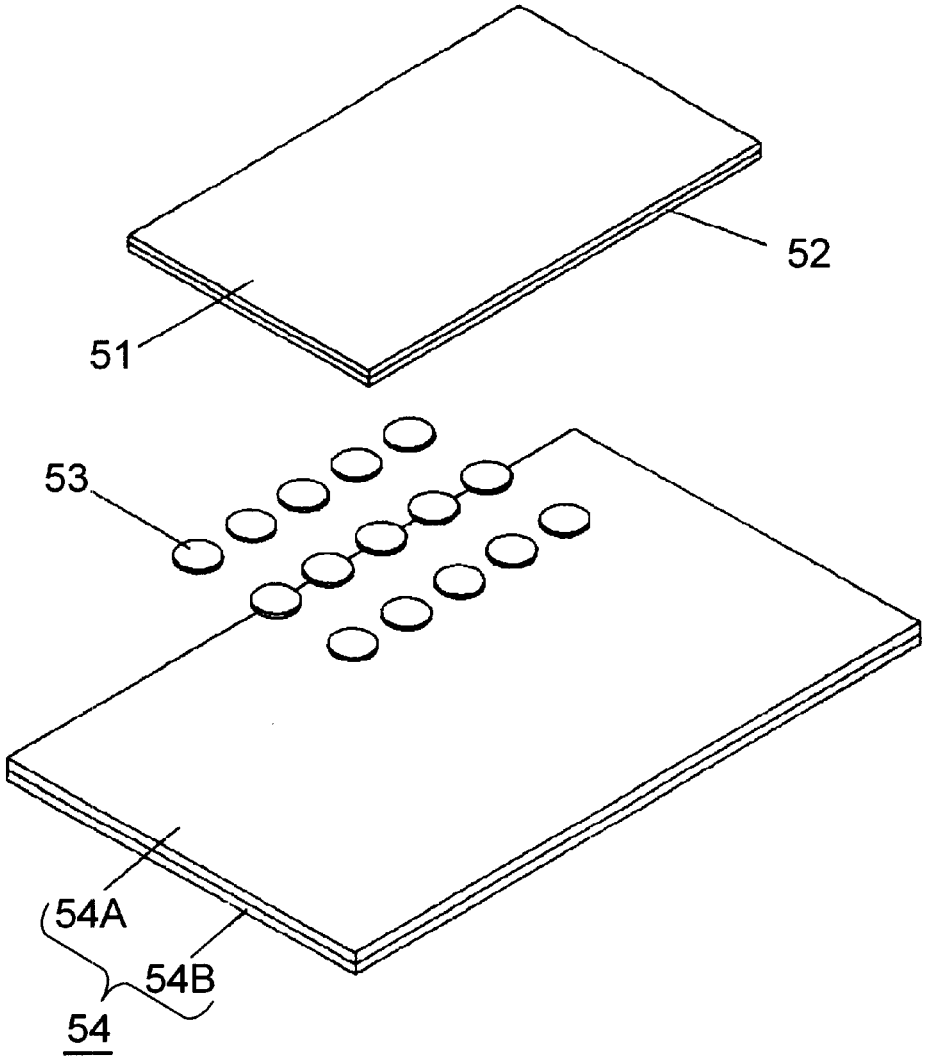
FIG. 9 PRIOR ART
FIG. 9 is an exploded perspective view of the prior-art movable contact unit.
Figure 10:
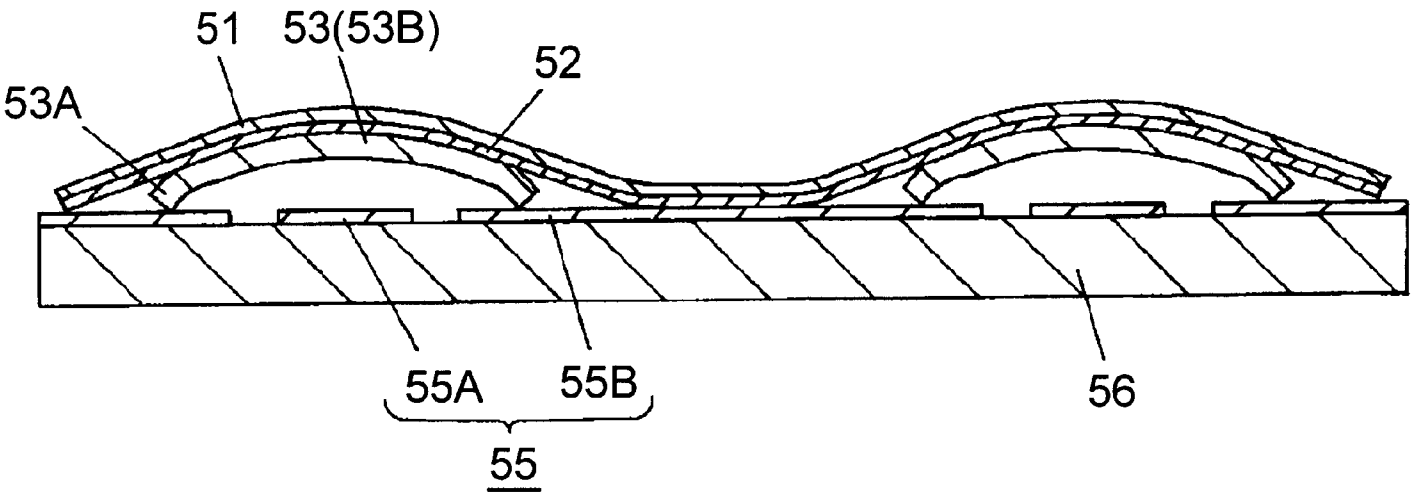
FIG. 10 PRIOR ART
FIG. 10 is a sectional view depicting a part of a panel switch employing the movable contact unit.
Figure 11:
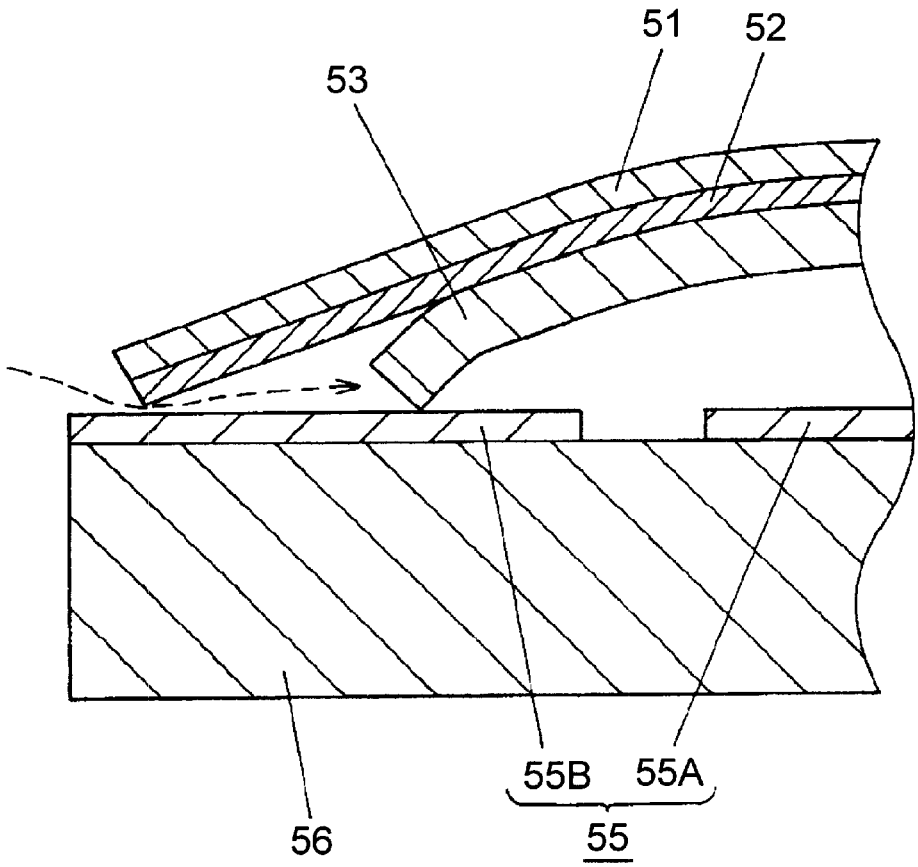
FIG. 11 PRIOR ART
FIG. 11 is a partially enlarged sectional view of the outer edge of the panel switch.

FIG. 6 is an exploded perspective view, and FIG. 7 is a sectional view depicting the movable contact unit in accordance with the second preferred embodiment.

In FIGS. 6 and 7, insulating base film 21,which is processed its outer shape into a predetermined shape, has adhesive layer 22 thereunder. The lower surface of base film 21 adhesively holds the top portion of dome-like shaped movable contact 3. Insulating film-made separator 4 covers all over the lower surface of base film 21 with movable contact 3 held therein.

Besides, base film 21 has the portion corresponding to movable contact 3 thereon, which is formed into projection 23 conforming to dome-like shaped movable contact 3. Root portion 23A of projection 23 is affixed with separator 4, as is the case with the structure disclosed in the first preferred embodiment.

Adhesive layer 22 is formed beneath base film 21 to hold the necessary number of movable contact 3.

The structure of the embodiment differs from that of the first embodiment in two ways below.

(1) non-adhesive ring-shaped portions 24 are formed at portions—each portion corresponds to truncated cone-shaped peripheral portion 3A of each movable contact 3—on adhesive layer 22.

(2) non-adhesive air passage 25 is disposed to connect between each of ring-shaped portions 24, i.e., each of movable contacts 3.

Now will be described how such-structured movable contact unit works.

When a depressing force is exerted on movable contacts 3, contact 3 partially flips over its shape. Upon the flip, air within movable contact 3 is compressed.

The compressed air escapes from under truncated cone-shaped peripheral portion 3A of movable contact 3 to non-adhesive air passage 25 connecting between movable contacts 3. The airflow decreases repulsion by the compressed air onto movable contact 3. As a result, contact 3 flips over by a constant steady depressing force, providing the operator with a nice feel in its operation.

Upon the flip over of movable contact 3, truncated cone-shaped peripheral portion 3A is subjected to concentrated stress. In movable contact 3 described above, however, peripheral portion 3A is not affixed to base film 21. Therefore, base film 21 does not interrupt the flip-over action of movable contact 3, so that good tactile feedback to the operator is obtained.

When a depressing force is applied to contact 3, the flip action brings electrical connections between fixed contacts 5 corresponding to each movable contact 3, i.e., between central fixed contact 5A and outer fixed contact 5B via movable contact 3. Upon release of the depressing force, movable contact 3 flips back to its original shape, by which corresponding fixed contacts 5 goes back to be non-conductive with each other.

Non-adhesive ring-shaped portion 24 and non-adhesive air passage 25 that connects between movable contacts 3 described earlier can be easily and simultaneously formed into a pattern by screen-printing. It is therefore possible to form non-adhesive portions 24 and 25 with high productivity and flexibility—a desired pattern of the adhesive layer and non-adhesive portion can be easily arranged. This fact contributes to a tactile "click" touch movable contact unit with high productivity and low cost.

Although the explanation has been presented supposing that non-adhesive portions 24 and 25 are both disposed in the movable contact unit, it is possible to form a unit having one of portions 24 and 25. In this case, as is normal, the acceptable effect differs according to whether having portion 24 or portion 25.

In the movable contact unit according to the first and second embodiments, it is possible to form the base film and the separator as a connected-hoop shape. Such a structure boosts up the productivity, thereby realizing more inexpensive movable contact unit.

According to the present invention, as described above, it is possible to provide a highly dustproof movable contact unit with a simple structure. It is also possible to form a panel switch using the movable contact unit into a dustproof structure, thereby realizing a panel switch with high connection reliability and positive tactile response.

What is claimed is:

1. A method of manufacturing a movable contact unit comprising the steps of:

(a) forming an adhesive layer beneath a base film made of an insulating film;

(b) allowing the adhesive layer to adhesively hold a top portion of a bottom-open, dome-like shaped movable contact made of a resilient conductive metallic sheet;

(c) following the step (b), affixing a release treatment-provided upper surface of a separator to the adhesive layer, with the movable contact being sandwiched between the base film and the separator; and (d) following the step (c), i) applying heat and pressure to both exterior sides of the base film and the separator; ii) forming a portion corresponding to the movable contact on the base film into a projection conforming to a dome-like shape of the movable contact; iii) firmly affixing a root portion of the projection on the base film to the separator through affixing the adhesive layer to the separator.

2. The method of manufacturing the movable contact unit according to claim 1, wherein a first roller having a predetermined pliability presses on a side of the base film, the first and a second rollers both of which are pre-heated at a determined temperature sandwich the base film and the separator therebetween, while applying heat and pressure to the base film and the separator.

3. The method of manufacturing the movable contact unit according to claim 1, wherein the movable contact has a truncated cone-shaped peripheral portion and a generally spherical-shaped center portion with a slight upward bulge, a drawing process given to the resilient metallic sheet forms a smooth curved contour between the center portion and the peripheral portion, and in the step (a), the adhesive layer is formed in an area other than a portion corresponding to the peripheral portion of the movable contact.

4. The method of manufacturing the movable contact unit according to claim 1, wherein, in the step (a), the adhesive layer is formed in an area except a non-adhesive portion for an air passage connecting between each of the movable contacts; and in the step (b), the adhesive layer adhesively holds a plurality of the movable contacts so as to keep each position of the movable contacts separately.

5. The method of manufacturing the movable contact unit according to claim 1, wherein the adhesive layer is formed by a screen printing in the step (a).

6. The method of manufacturing the movable contact unit according to claim 2, wherein the adhesive layer is formed by a screen printing in the step (a).

7. The method of manufacturing the movable contact unit according to claim 3, wherein the adhesive layer is formed by a screen printing in the step (a).

8. The method of manufacturing the movable contact unit according to claim 4, wherein the adhesive layer is formed by a screen printing in the step (a).

9. A method of manufacturing a panel switch comprising the steps of:

(a) forming an adhesive layer beneath a base film of an insulating film;

(b) allowing the adhesive layer to adhesively hold a top portion of a bottom-open, dome-like shaped movable contact made of a conductive metallic sheet having resiliency;

(c) following the step (b), affixing a release treatment-provided upper surface of a separator to the adhesive layer, with the movable contact being sandwiched between the base film and the separator;

(d) following the step (c), i) applying heat and pressure to both exterior sides of the base film and the separator; ii) forming a portion corresponding to the movable contact on the base film into a projection conforming to a dome-like shape of the movable contact; iii) firmly affixing a root portion of the projection on the base film to the separator through affixing the adhesive layer to the separator;

(e) disposing a fixed contact at a position, on a wiring board, corresponding to the movable contact;

(f) removing the separator from the movable contact unit; and (g) affixing the movable contact unit with the adhesive layer to the wiring board so that a position of the movable contact corresponds to a position of a fixed contact.

* * * * *